US006806800B1

(12) United States Patent
Castonguay et al.

(10) Patent No.: US 6,806,800 B1
(45) Date of Patent: Oct. 19, 2004

(54) ASSEMBLY FOR MOUNTING A MOTOR OPERATOR ON A CIRCUIT BREAKER

(75) Inventors: Roger Neil Castonguay, Terryville, CT (US); Girish Mruthunjaya Hassan, Plainville, CT (US); Dean Arthur Robarge, Southington, CT (US); Dave Scot Christensen, Harwinton, CT (US)

(73) Assignee: General Electric Company, Schenectady, NY (US)

( * ) Notice: Subject to any disclaimer, the term of this patent is extended or adjusted under 35 U.S.C. 154(b) by 657 days.

(21) Appl. No.: 09/692,782

(22) Filed: Oct. 19, 2000

(51) Int. Cl.[7] ..... H01H 3/00
(52) U.S. Cl. ..... 335/68; 335/202; 335/71
(58) Field of Search ..... 335/68–72, 165–176, 335/202, 23–25, 6, 14, 20

(56) References Cited

U.S. PATENT DOCUMENTS

| | | | | |
|---|---|---|---|---|
| 2,340,682 A | | 2/1944 | Powell | 200/147 |
| 2,719,203 A | | 9/1955 | Gelzheiser et al. | 200/144 |
| 2,937,254 A | | 5/1960 | Ericson | 200/114 |
| 3,158,717 A | | 11/1964 | Jencks et al. | 200/116 |
| 3,162,739 A | | 12/1964 | Klein et al. | 200/88 |
| 3,197,582 A | | 7/1965 | Norden | 200/50 |
| 3,307,002 A | | 2/1967 | Cooper | 200/116 |
| 3,517,356 A | | 6/1970 | Hanafusa | 335/16 |
| 3,631,369 A | | 12/1971 | Menocal | 337/110 |
| 3,803,455 A | | 4/1974 | Willard | 317/33 SC |
| 3,883,781 A | | 5/1975 | Cotton | 317/14 R |
| 4,075,584 A | * | 2/1978 | Castonguay et al. | 335/20 |
| 4,121,077 A | * | 10/1978 | Mrenna et al. | 200/308 |
| 4,129,762 A | | 12/1978 | Bruchet | 200/153 G |
| 4,144,513 A | | 3/1979 | Shaffer et al. | 335/46 |
| 4,158,119 A | | 6/1979 | Krakik | 200/240 |
| 4,165,453 A | | 8/1979 | Hennemann | 200/153 G |
| 4,166,988 A | | 9/1979 | Ciarcia et al. | 335/9 |
| 4,220,934 A | | 9/1980 | Wafer et al. | 335/16 |
| 4,255,732 A | | 3/1981 | Wafer et al. | 335/16 |
| 4,259,651 A | | 3/1981 | Yamat | 335/16 |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |

(List continued on next page.)

*Primary Examiner*—Lincoln Donovan
(74) *Attorney, Agent, or Firm*—Cantor Colburn LLP

(57) ABSTRACT

An assembly designed for connecting a motor operator mechanism to side frames of a circuit breaker operating mechanism is disclosed. The assembly comprising a plate connected between the side frames of the operating mechanism and a bracket portion secured to the plate and engages the motor operating mechanism. The bracket portion couples and aligns the motor operator mechanism and the circuit breaker operating mechanism.

23 Claims, 8 Drawing Sheets

U.S. PATENT DOCUMENTS

| | | | | |
|---|---|---|---|---|
| 4,263,492 | A | | 4/1981 | Maier et al. ..... 200/288 |
| 4,276,527 | A | | 6/1981 | Gerbert-Gaillard et al. ... 335/39 |
| 4,297,663 | A | | 10/1981 | Seymour et al. ..... 335/20 |
| 4,301,342 | A | | 11/1981 | Castonguay et al. .. 200/153 SC |
| 4,360,852 | A | | 11/1982 | Gilmore ..... 361/98 |
| 4,368,444 | A | | 1/1983 | Preuss et al. ..... 335/166 |
| 4,375,021 | A | | 2/1983 | Pardini et al. ..... 200/147 B |
| 4,375,022 | A | | 2/1983 | Daussin et al. ..... 200/148 R |
| 4,376,270 | A | | 3/1983 | Staffen ..... 335/31 |
| 4,383,146 | A | | 5/1983 | Bur ..... 200/17 R |
| 4,392,036 | A | | 7/1983 | Troebel et al. ..... 200/322 |
| 4,393,283 | A | | 7/1983 | Masuda ..... 200/51.09 |
| 4,401,872 | A | | 8/1983 | Boichot-Castagne et al. ..... 200/153 G |
| 4,409,573 | A | | 10/1983 | Di Marco et al. ..... 335/16 |
| 4,435,690 | A | | 3/1984 | Link et al. ..... 335/37 |
| 4,467,297 | A | | 8/1984 | Boichot-Castagne et al. .. 335/8 |
| 4,467,299 | A | * | 8/1984 | Collin et al. ..... 335/20 |
| 4,468,645 | A | | 8/1984 | Gerbert-Gaillard et al. ... 335/42 |
| 4,470,027 | A | | 9/1984 | Link et al. ..... 335/16 |
| 4,479,143 | A | | 10/1984 | Watanabe et al. ..... 358/44 |
| 4,488,133 | A | | 12/1984 | McClellan et al. ..... 335/16 |
| 4,492,941 | A | | 1/1985 | Nagel ..... 335/13 |
| 4,541,032 | A | | 9/1985 | Schwab ..... 361/331 |
| 4,546,224 | A | | 10/1985 | Mostosi ..... 200/153 G |
| 4,550,360 | A | | 10/1985 | Dougherty ..... 361/93 |
| 4,562,419 | A | | 12/1985 | Preuss et al. ..... 335/195 |
| 4,589,052 | A | | 5/1986 | Dougherty ..... 361/94 |
| 4,595,812 | A | | 6/1986 | Tamaru et al. ..... 200/307 |
| 4,611,187 | A | | 9/1986 | Banfi ..... 335/16 |
| 4,612,430 | A | | 9/1986 | Sloan et al. ..... 200/327 |
| 4,616,198 | A | | 10/1986 | Pardini ..... 335/16 |
| 4,622,444 | A | | 11/1986 | Kandatsu et al. ..... 200/303 |
| 4,631,625 | A | | 12/1986 | Alexander et al. ..... 361/94 |
| 4,642,431 | A | | 2/1987 | Tedesco et al. ..... 200/153 G |
| 4,644,438 | A | | 2/1987 | Puccinelli et al. ..... 361/75 |
| 4,649,247 | A | | 3/1987 | Preuss et al. ..... 200/244 |
| 4,658,322 | A | | 4/1987 | Rivera ..... 361/37 |
| 4,672,501 | A | | 6/1987 | Bilac et al. ..... 361/96 |
| 4,675,481 | A | | 6/1987 | Markowski et al. .... 200/144 R |
| 4,682,264 | A | | 7/1987 | Demeyer ..... 361/96 |
| 4,689,712 | A | | 8/1987 | Demeyer ..... 361/96 |
| 4,694,373 | A | | 9/1987 | Demeyer ..... 361/96 |
| 4,710,845 | A | | 12/1987 | Demeyer ..... 361/96 |
| 4,717,985 | A | | 1/1988 | Demeyer ..... 361/96 |
| 4,733,211 | A | | 3/1988 | Castonguay et al. ..... 335/192 |
| 4,733,321 | A | | 3/1988 | Lindeperg ..... 361/96 |
| 4,764,650 | A | | 8/1988 | Bur et al. ..... 200/153 G |
| 4,768,007 | A | | 8/1988 | Mertz et al. ..... 335/202 |
| 4,780,786 | A | | 10/1988 | Weynachter et al. ..... 361/87 |
| 4,831,221 | A | | 5/1989 | Yu et al. ..... 200/553 |
| 4,870,531 | A | | 9/1989 | Danek ..... 361/93 |
| 4,883,931 | A | | 11/1989 | Batteux et al. ..... 200/148 R |
| 4,884,047 | A | | 11/1989 | Baginski et al. ..... 335/10 |
| 4,884,164 | A | | 11/1989 | Dziura et al. ..... 361/97 |
| 4,900,882 | A | | 2/1990 | Bernard et al. ..... 200/147 R |
| 4,910,485 | A | | 3/1990 | Bolongeat-Mobleu et al. ..... 335/195 |
| 4,914,541 | A | | 4/1990 | Tripodi et al. ..... 361/94 |
| 4,916,420 | A | | 4/1990 | Bartolo et al. ..... 335/172 |
| 4,916,421 | A | | 4/1990 | Pardini et al. ..... 335/182 |
| 4,926,282 | A | | 5/1990 | McGhie ..... 361/102 |
| 4,935,590 | A | | 6/1990 | Malkin et al. ..... 200/148 A |
| 4,937,706 | A | | 6/1990 | Schueller et al. ..... 361/396 |
| 4,939,492 | A | | 7/1990 | Raso et al. ..... 335/42 |
| 4,943,691 | A | | 7/1990 | Mertz et al. ..... 200/151 |
| 4,943,888 | A | | 7/1990 | Jacob et al. ..... 361/96 |
| 4,950,855 | A | | 8/1990 | Bolongeat-Mobleu et al. ..... 200/148 A |
| 4,951,019 | A | | 8/1990 | Gula ..... 335/166 |
| 4,952,897 | A | | 8/1990 | Barnel et al. ..... 335/147 |
| 4,958,135 | A | | 9/1990 | Baginski et al. ..... 335/8 |
| 4,965,543 | A | | 10/1990 | Batteux ..... 335/174 |
| 4,983,788 | A | | 1/1991 | Pardini ..... 200/16 R |
| 5,001,313 | A | | 3/1991 | Leclercq et al. ..... 200/148 B |
| 5,004,878 | A | | 4/1991 | Seymour et al. ..... 200/144 R |
| 5,029,301 | A | | 7/1991 | Nebon et al. ..... 335/16 |
| 5,030,804 | A | | 7/1991 | Abri ..... 200/323 |
| 5,057,655 | A | | 10/1991 | Kersusan et al. ..... 200/148 B |
| 5,077,627 | A | | 12/1991 | Fraisse ..... 361/93 |
| 5,083,081 | A | | 1/1992 | Barrault et al. ..... 324/126 |
| 5,093,643 | A | * | 3/1992 | Altenhof, Jr. et al. ..... 335/20 |
| 5,095,183 | A | | 3/1992 | Raphard et al. ..... 200/148 A |
| 5,103,198 | A | | 4/1992 | Morel et al. ..... 335/6 |
| 5,115,371 | A | | 5/1992 | Tripodi ..... 361/106 |
| 5,120,921 | A | | 6/1992 | DiMarco et al. ..... 200/401 |
| 5,132,865 | A | | 7/1992 | Mertz et al. ..... 361/6 |
| 5,138,121 | A | | 8/1992 | Streich et al. ..... 200/293 |
| 5,140,115 | A | | 8/1992 | Morris ..... 200/308 |
| 5,153,802 | A | | 10/1992 | Mertz et al. ..... 361/18 |
| 5,155,315 | A | | 10/1992 | Malkin et al. ..... 200/148 R |
| 5,166,483 | A | | 11/1992 | Kersusan et al. ..... 200/144 A |
| 5,172,087 | A | | 12/1992 | Castonguay et al. ..... 335/160 |
| 5,178,504 | A | | 1/1993 | Falchi ..... 411/553 |
| 5,184,717 | A | | 2/1993 | Chou et al. ..... 200/401 |
| 5,187,339 | A | | 2/1993 | Lissandrin ..... 200/148 F |
| 5,198,956 | A | | 3/1993 | Dvorak ..... 361/106 |
| 5,200,724 | A | | 4/1993 | Gula et al. ..... 335/166 |
| 5,210,385 | A | | 5/1993 | Morel et al. ..... 200/146 R |
| 5,239,150 | A | | 8/1993 | Bolongeat-Mobleu et al. ..... 200/148 R |
| 5,260,533 | A | | 11/1993 | Livesey et al. ..... 200/401 |
| 5,262,744 | A | | 11/1993 | Arnold et al. ..... 335/8 |
| 5,280,144 | A | | 1/1994 | Bolongeat-Mobleu et al. ..... 200/148 R |
| 5,281,776 | A | | 1/1994 | Morel et al. ..... 200/144 |
| 5,296,660 | A | | 3/1994 | Morel et al. ..... 200/146 R |
| 5,296,664 | A | | 3/1994 | Crookston et al. ..... 200/401 |
| 5,298,874 | A | | 3/1994 | Morel et al. ..... 335/8 |
| 5,300,907 | A | | 4/1994 | Nereau et al. ..... 335/172 |
| 5,310,971 | A | | 5/1994 | Vial et al. ..... 200/244 |
| 5,313,180 | A | | 5/1994 | Vial et al. ..... 335/16 |
| 5,317,471 | A | | 5/1994 | Izoard et al. ..... 361/105 |
| 5,331,500 | A | | 7/1994 | Corcoles et al. ..... 361/93 |
| 5,334,808 | A | | 8/1994 | Bur et al. ..... 200/50 |
| 5,341,191 | A | | 8/1994 | Crookston et al. ..... 335/16 |
| 5,347,096 | A | | 9/1994 | Bolongeat-Mobleu et al. ..... 200/148 B |
| 5,347,097 | A | | 9/1994 | Bolongeat-Mobleu et al. ..... 200/148 B |
| 5,350,892 | A | | 9/1994 | Rozier ..... 200/144 B |
| 5,357,066 | A | | 10/1994 | Morel et al. ..... 200/17 R |
| 5,357,068 | A | | 10/1994 | Rozier ..... 200/148 R |
| 5,357,394 | A | | 10/1994 | Piney ..... 361/72 |
| 5,361,052 | A | | 11/1994 | Ferullo et al. ..... 335/172 |
| 5,373,130 | A | | 12/1994 | Barrault et al. ..... 200/147 R |
| 5,379,013 | A | | 1/1995 | Coudert ..... 335/17 |
| 5,381,119 | A | * | 1/1995 | Robbins et al. ..... 335/132 |
| 5,408,208 | A | * | 4/1995 | DiMarco et al. ..... 335/14 |
| 5,424,701 | A | | 6/1995 | Castonguay et al. ..... 335/172 |
| 5,438,176 | A | | 8/1995 | Bonnardel et al. ..... 200/400 |
| 5,440,088 | A | | 8/1995 | Coudert et al. ..... 200/303 |
| 5,449,871 | A | | 9/1995 | Batteux et al. ..... 200/401 |
| 5,450,048 | A | | 9/1995 | Leger et al. ..... 335/132 |
| 5,451,729 | A | | 9/1995 | Onderka et al. ..... 200/18 |
| 5,457,295 | A | | 10/1995 | Tanibe et al. ..... 200/293 |
| 5,467,069 | A | | 11/1995 | Payet-Burin et al. ..... 335/42 |
| 5,469,121 | A | | 11/1995 | Payet-Burin ..... 335/16 |
| 5,475,558 | A | | 12/1995 | Barjonnet et al. ..... 361/64 |
| 5,477,016 | A | | 12/1995 | Baginski et al. ..... 200/43.11 |
| 5,479,143 | A | | 12/1995 | Payet-Burin ..... 335/202 |

| | | | | | |
|---|---|---|---|---|---|
| 5,483,212 | A | | 1/1996 | Lankuttis et al. | 335/132 |
| 5,485,343 | A | | 1/1996 | Santos et al. | 361/115 |
| D367,265 | S | | 2/1996 | Yamagata et al. | D13/160 |
| 5,493,083 | A | | 2/1996 | Olivier | 200/17 R |
| 5,504,284 | A | | 4/1996 | Lazareth et al. | 200/50 R |
| 5,504,290 | A | | 4/1996 | Baginski et al. | 200/401 |
| 5,510,761 | A | | 4/1996 | Boder et al. | 335/172 |
| 5,512,720 | A | | 4/1996 | Coudert et al. | 200/400 |
| 5,515,018 | A | | 5/1996 | DiMarco et al. | 335/16 |
| 5,519,367 | A | * | 5/1996 | Castonguay et al. | 335/14 |
| 5,519,561 | A | | 5/1996 | Mrenna et al. | 361/105 |
| 5,534,674 | A | | 7/1996 | Steffens | 218/154 |
| 5,534,832 | A | | 7/1996 | Duchemin et al. | 335/16 |
| 5,534,835 | A | | 7/1996 | McColloch et al. | 335/172 |
| 5,534,840 | A | | 7/1996 | Cuingnet | 337/1 |
| 5,539,168 | A | | 7/1996 | Linzenich | 200/303 |
| 5,543,595 | A | | 8/1996 | Mader et al. | 200/401 |
| 5,552,755 | A | | 9/1996 | Fello et al. | 335/18 |
| 5,581,219 | A | | 12/1996 | Nozawa et al. | 335/132 |
| 5,604,656 | A | | 2/1997 | Derrick et al. | 361/187 |
| 5,608,367 | A | | 3/1997 | Zoller et al. | 335/132 |
| 5,646,586 | A | * | 7/1997 | Castonguay et al. | 335/132 |
| 5,784,233 | A | | 7/1998 | Bastard et al. | 361/36 |

FOREIGN PATENT DOCUMENTS

| | | |
|---|---|---|
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 0612092 A1 | 2/1994 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

ASSEMBLY FOR MOUNTING A MOTOR OPERATOR ON A CIRCUIT BREAKER

BACKGROUND OF THE INVENTION

This invention relates to a motor operator, and, more particularly, to a motor operator for circuit breakers.

It is known in the art to provide molded case circuit breakers for electrical systems. The circuit breaker is operative to disengage the electrical system under certain operating conditions. The use of motor operators to allow the motor-assisted operation of electrical circuit breakers is well known. The motor operator allows the circuit breaker to be operated remotely and to be opened, closed or reset after tripping of the circuit breaker.

The motor operator is typically secured to the top of a circuit breaker housing. A lever within the motor operator mechanically interacts with a circuit breaker operating handle, which extends from the circuit breaker housing. The lever is operatively connected to a motor within the motor operator. The motor drives the lever, which, in turn, moves the operating handle to operate the circuit breaker. The operating handle is moved between "on", "off", and "reset" positions, depending on the rotational direction of the motor.

A plurality of buttons external to the motor operator controls electrical current to the motor. The rotational direction of the motor is changed depending on which of these buttons is selected by operating personnel. Thus, the operating personnel can select one button to place the operating handle in the "on" position, and another button to place the operating handle in the "off" or "reset" positions.

When the handle is moved to the "on" position, electrical contacts within the circuit breaker are brought into contact with each other, allowing electrical current to flow through the circuit breaker. When the handle is moved to the "off" position, the electrical contacts are separated, stopping the flow of electrical current through the circuit breaker. When the handle is moved to the "reset" position, an operating mechanism within the circuit breaker is reset, as is necessary after the operating mechanism has tripped in response to an overcurrent condition in the electrical circuit being protected by the circuit breaker.

Due to the mounting of the motor operator onto the case of the circuit breaker, excessive lost motion can result between the motor operator and the circuit breaker under extreme operational loads. Excessive motion caused by the motor operator not being rigidly secured to the circuit breaker can result in excessive lost motion between the motor operator and the circuit breaker such that the motor operator is unable to sufficiently move the handle in order to turn the circuit breaker to the desired position (ie. off, on, reset).

BRIEF SUMMARY OF THE INVENTION

The above discussed and other drawbacks and deficiencies are overcome or alleviated by an assembly for connecting a motor operator mechanism to side frames of a circuit breaker operating mechanism. The assembly comprising a plate connected between the side frames of the operating mechanism and a bracket portion secured to the plate and engages the motor operating mechanism. The bracket portion couples and aligns the motor operator mechanism and the circuit breaker operating mechanism.

BRIEF DESCRIPTION OF THE DRAWINGS

The present invention will now be described, by way of example, with reference to the following FIGURES, in which.

DETAILED DESCRIPTION OF THE INVENTION

Figure 1:
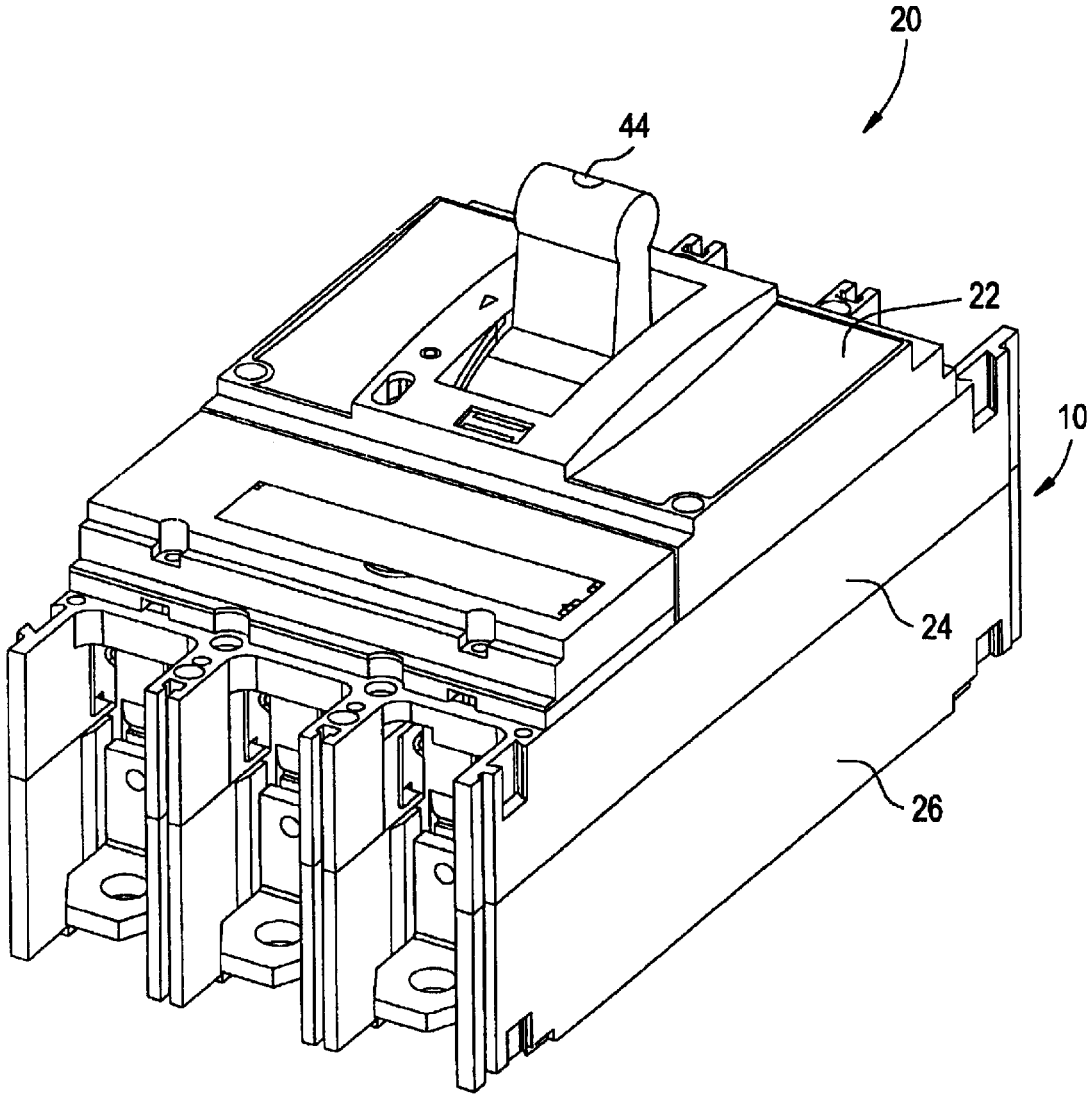
FIG. 1 is a perspective view of a circuit breaker.
Figure 2:
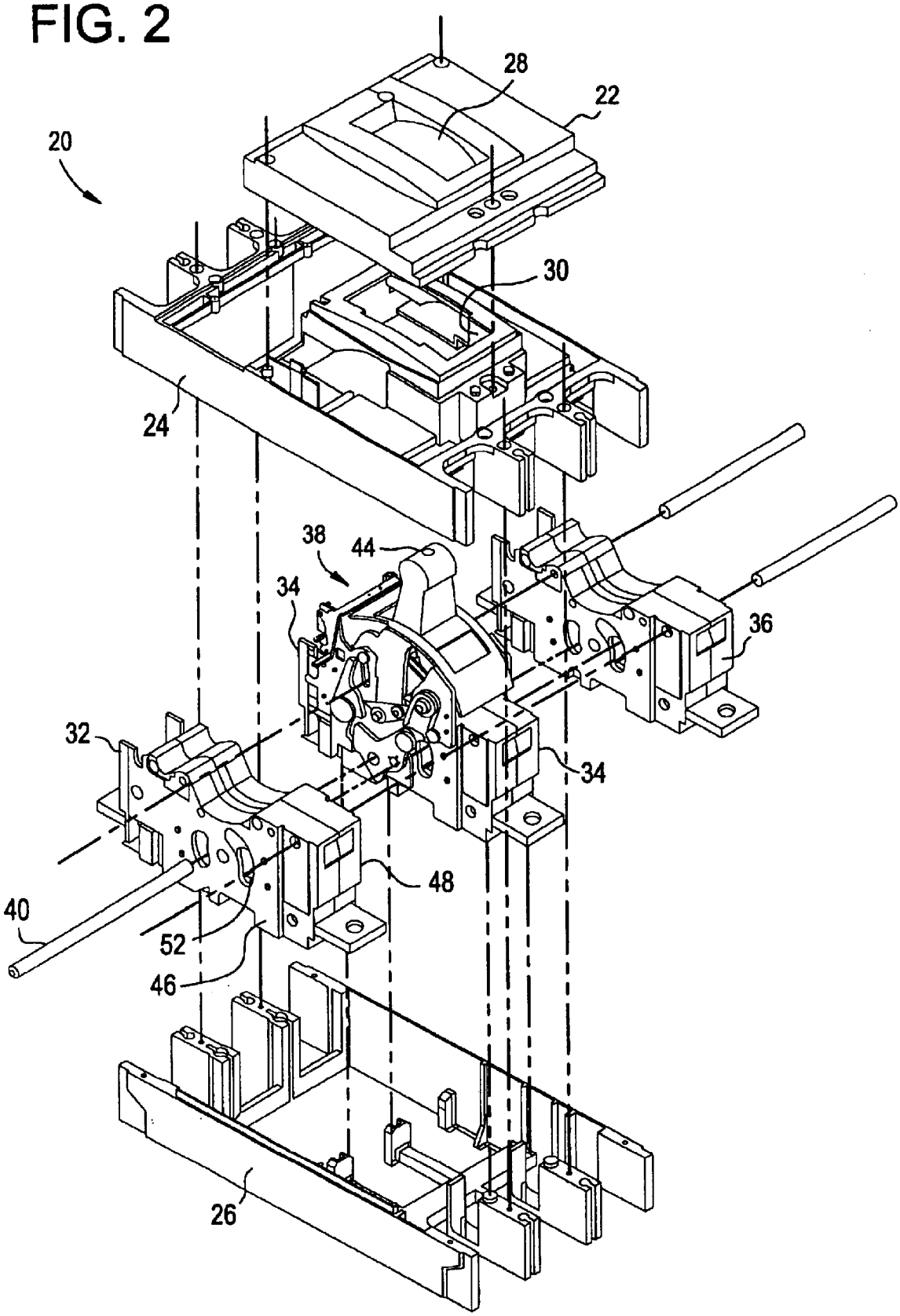
FIG. 2 is an exploded view of the circuit breaker of FIG. 1.

Referring to FIGS. 1 and 2, a circuit breaker 20 is shown. Circuit breaker 20 generally includes a molded case, shown generally at 10, having a top cover 22 attached to a mid cover 24 coupled to a base 26. An opening 28, formed generally centrally within top cover 22, is positioned to mate with a corresponding mid cover opening 30, which is accordingly aligned with opening 28 when the mid cover 24 and the top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36. Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38. In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36.

Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
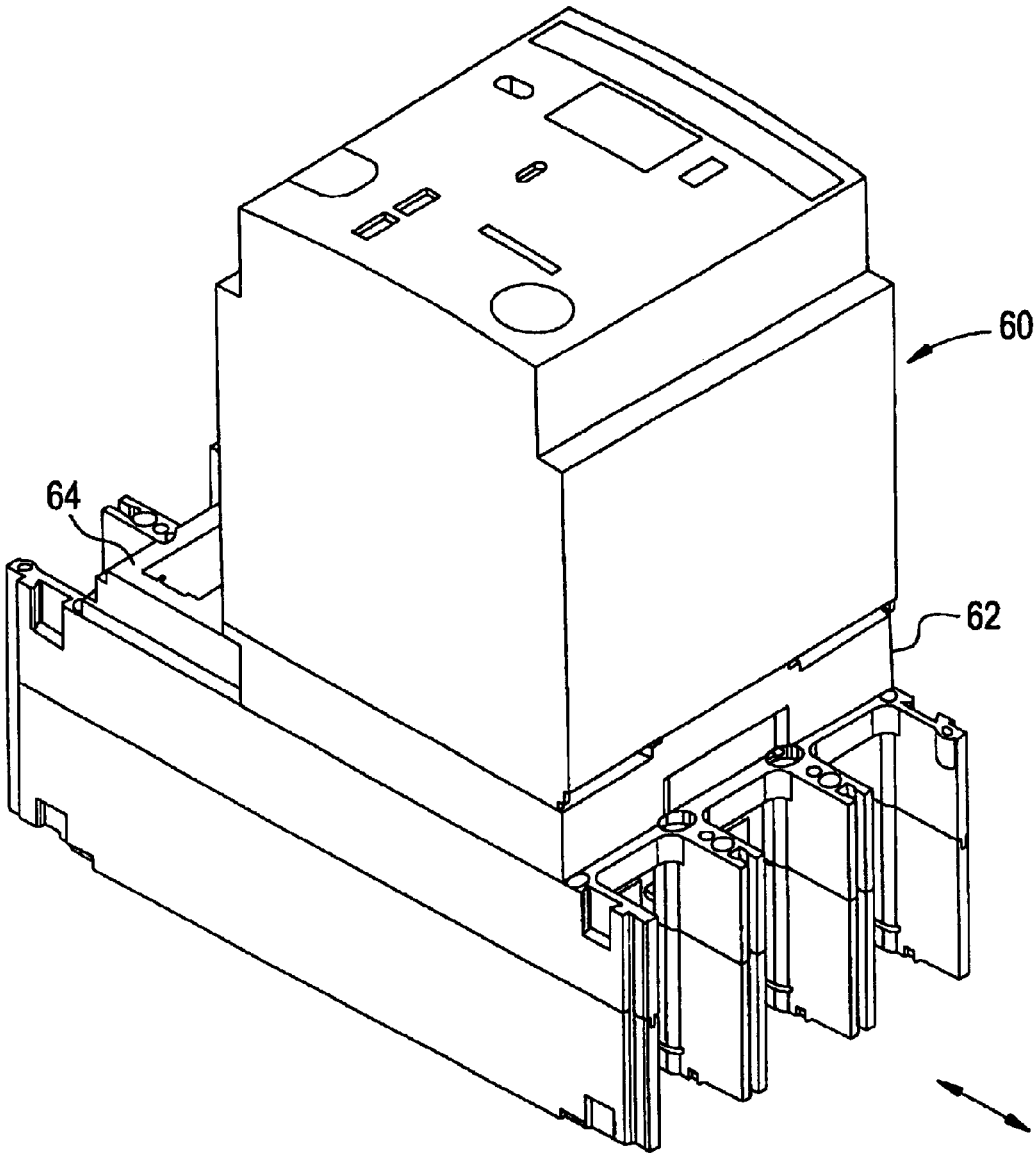
FIG. 3 is a perspective view of a motor operator mechanism mounted on a front face of the circuit breaker of FIG. 1.

Referring to FIG. 3, a motor operator mechanism shown generally at 60 is mounted on a mounting base 62 which is secured to the mid cover 24. When it is desired to mount the motor operator mechanism 60 onto a front face 64 of the circuit breaker 10, the top cover 22 is typically replaced by the mounting base 62. Motor operator mechanism 60 affords the capability of either local manual circuit breaker operation or remotely initiated motorized circuit breaker operation.

Figure 4:
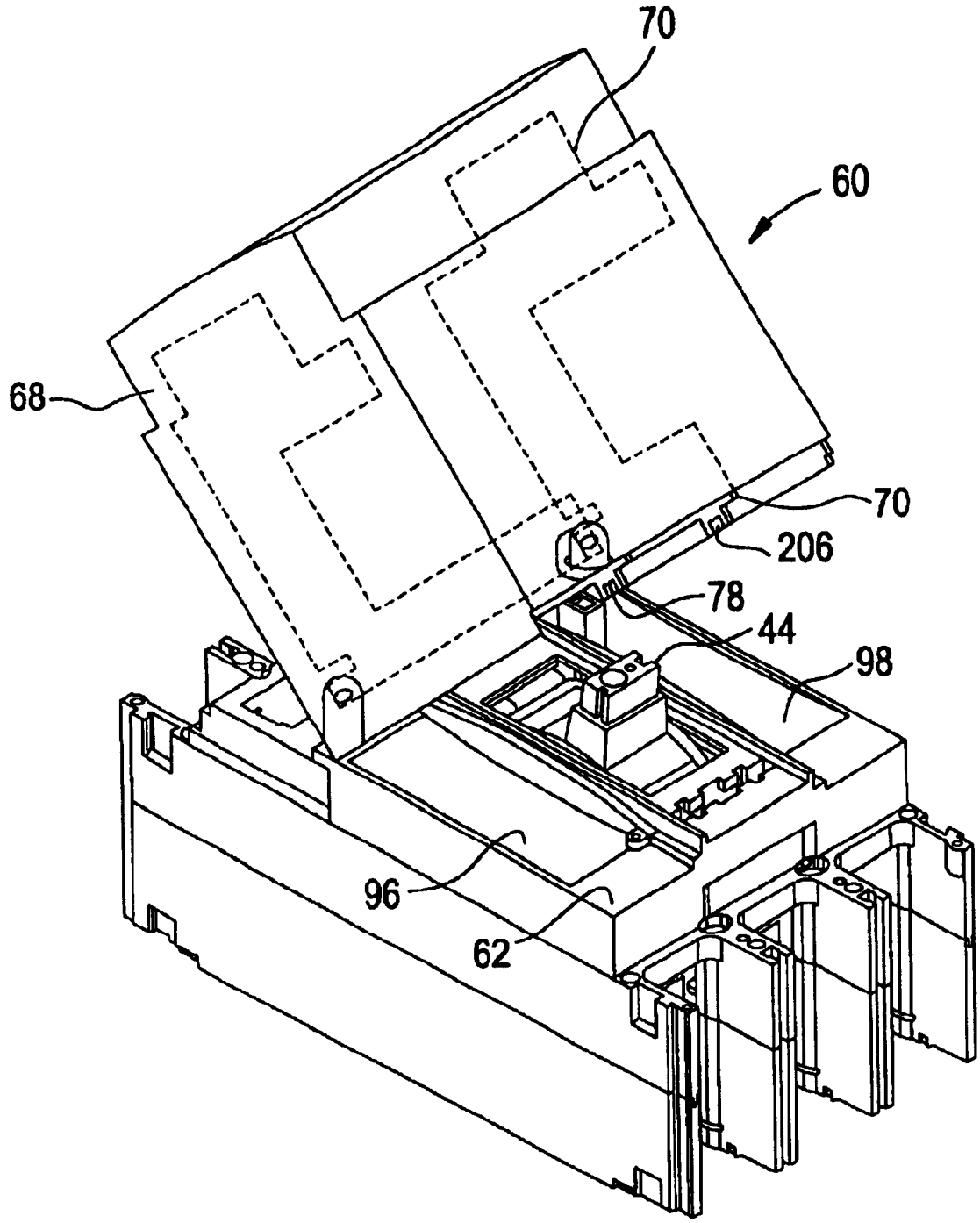
FIG. 4 is a perspective view of the circuit breaker and the motor operator mechanism of FIG. 3 where the motor operator mechanism is shown in a retracted position.
Figure 5:
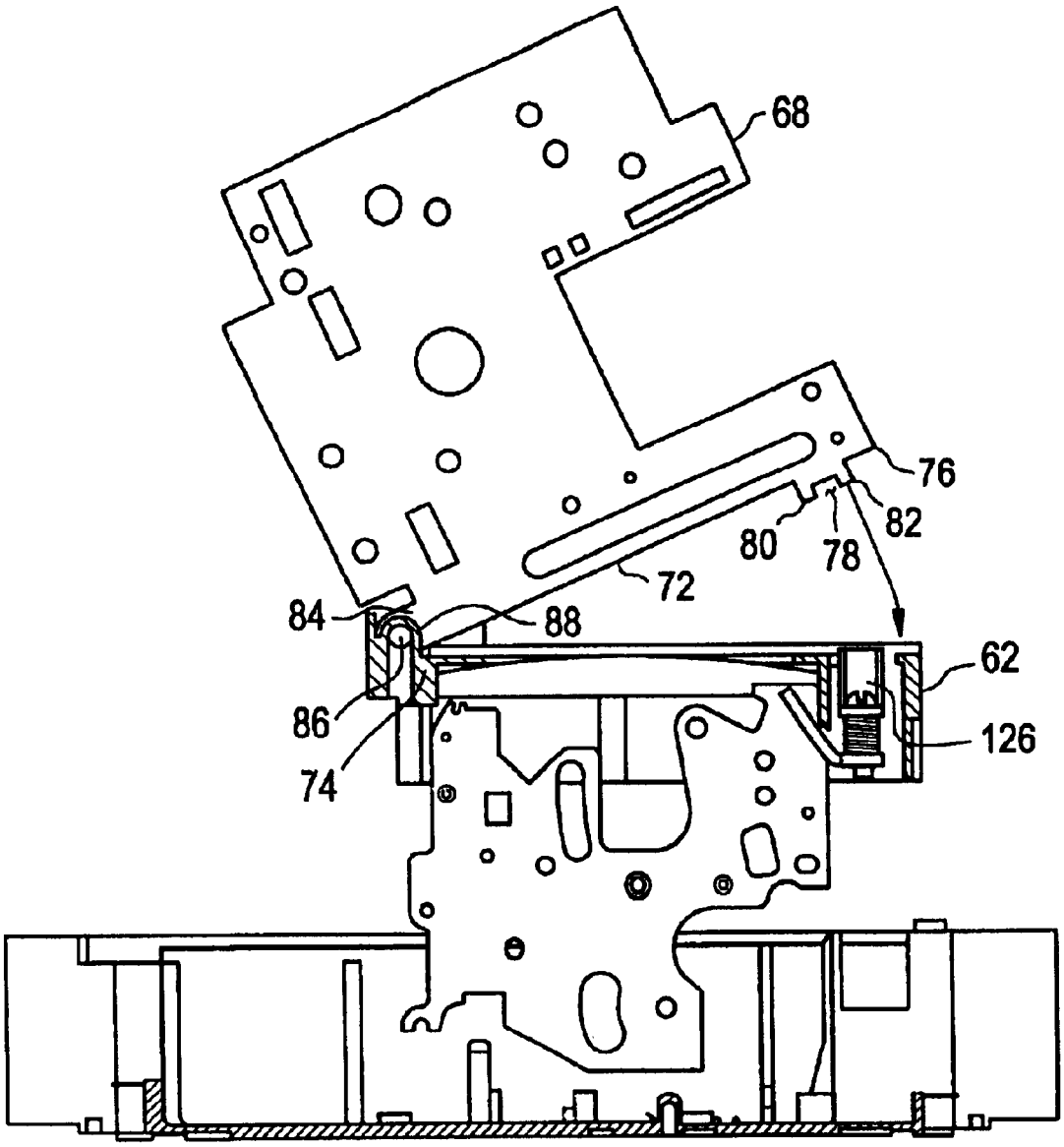
FIG. 5 is an internal side view of the motor operator mechanism and circuit breaker of FIG. 4.

Referring to FIGS. 4 and 5, the motor operator mechanism 60 is shown in a retracted position disengaged from the toggle handle 44. When in the disengaged position, various accessories (not shown), such as but not limited to auxiliary switches, may be installed within recesses 66 located within the mounting base 62.

Motor operator mechanism 60 includes a case and two side frames 68, 70 (shown in phantom) mounted within the case. The side frames 68, 70 provide support for the motor operator mechanism 60, in particular the mechanical structure, such as handle drive rollers (not shown), which move the toggle handle 44 to a desired position (ie. off, on, reset). Each side frame 68, 70 includes an edge 72 traversing from an end 74 located on the line side to an end 76 located on the load side. Located along edge 72 of each side frame 68, 70 and proximate respective end 76 is a recess 78 formed therein. Preferably, each respective recess 78 is formed between projections 80, 82 extending outward and side-by-side from each edge 72 of each respective side frame 68, 70. Located at end 74 of edge 72 of each side frame 68, 70 is an extension 84 having an aperture 86.

Figure 6:
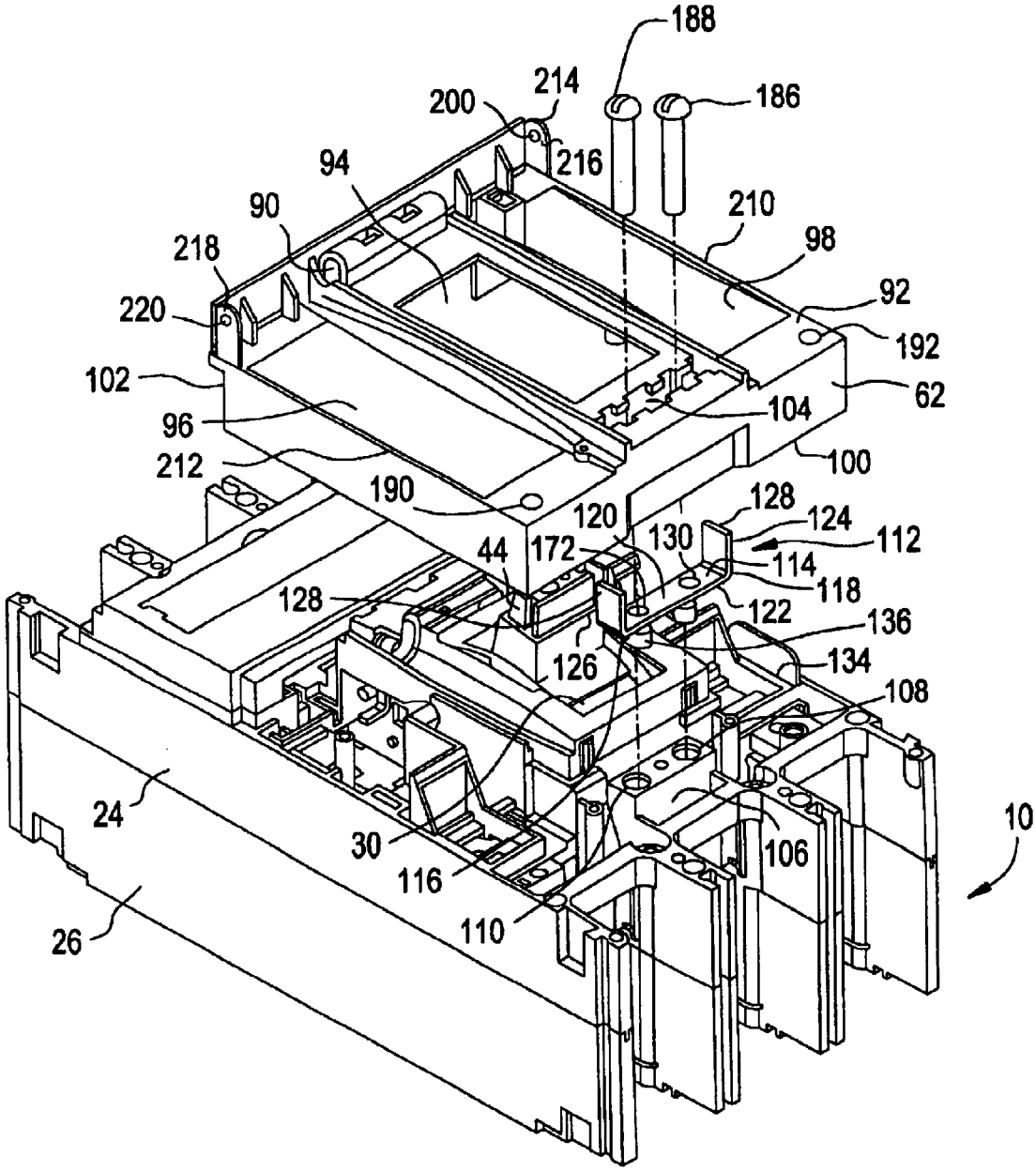
FIG. 6 is a perspective assembly view of a mounting base and a mounting assembly.

Referring to FIG. 6, the mounting base 62 is shown in detail. The mounting base 62 includes a main body portion 92 having an opening 94, formed generally centrally within the mounting base 62. Opening 94 is positioned to mate with a corresponding mid cover opening 30 through which the toggle handle 44 protrudes. When the mounting base 62 is coupled with the mid cover 24, openings 94, 30 are accordingly aligned one another. The mounting base 62 also includes two openings 96, 98 on opposing sides of opening 94 to allow access for mounting electrical accessories when the motor operator mechanism 60 is in the retracted position (FIG. 4). The mounting base 62 further includes an end 102 located on the load side and an end 100 located on the line side. Located between ends 100, 102 are respective sides 210 and 212. Preferably, sides 210, 212 are parallel to each other and with the ends 100, 102 form a generally rectangular shape. Located along end 102 proximate to side 210 is a projection 214 having a hole 216. Located along end 102 proximate to side 212 is a projection 218 having a hole 220. Adjacent opening 94 and located at end 100 is a cutout portion 104 that extends through the mounting base 62. FIG. 6 also shows a portion 106 of the mid cover 24 located on the load side that includes two apertures 108, 110.

A bracket portion is shown generally at 112. Bracket portion 112 includes a base 114 having an end 116 and an opposing end 118. Base 114 also includes a surface 120 and an opposing surface 122. Extending outward from end 118 and surface is a leg 124. Extending outward from end 116 is a leg 126. The legs 124, 126 and base 114 are generally planar with each leg 124, 126 having a free end 128. Located within the base 114 are preferably two apertures 130, 132 that extend through surfaces 120, 122. Aligned with apertures 130, 132 are respective bushings 134, 136, preferably made of steel that extends outward from surface. The bushings 134, 136 may be riveted or welded onto the surface.

Figure 7:
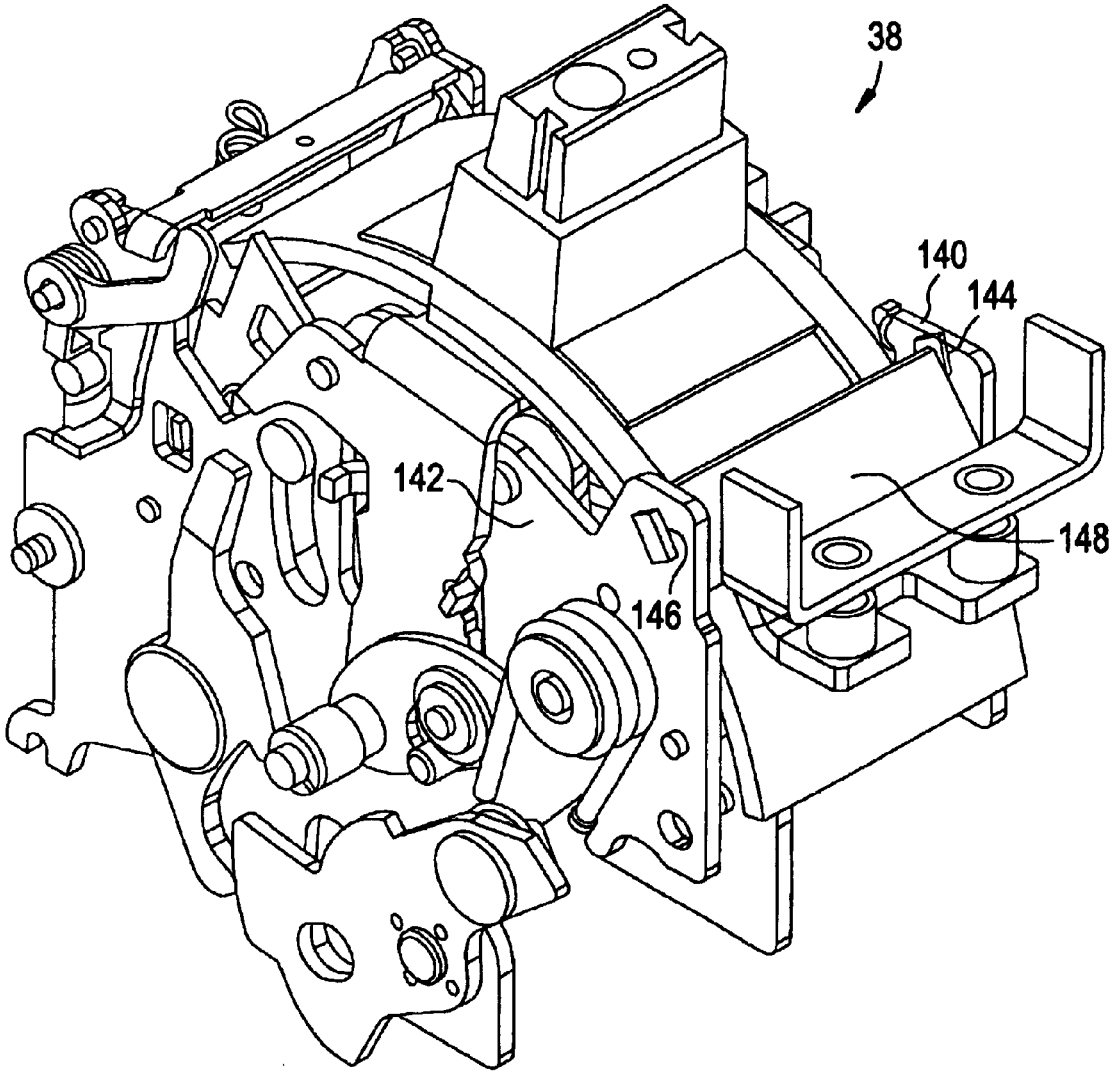
FIG. 7 is a perspective view of a circuit breaker operating mechanism and a plate and a bracket portion of the mounting assembly of FIG. 6.

Referring to FIG. 7, operating mechanism 38 is shown. Operating mechanism 38 includes side frames 140, 142 generally parallel to each other as mounted within the operating mechanism 38. Each side frame 140, 142 includes a respective opening 144, 146. Positioned and secured between side frames is a plate 150 as will be detailed in the description of the assembly of the motor operator mechanism 60 to the circuit breaker 10.

Figure 8:
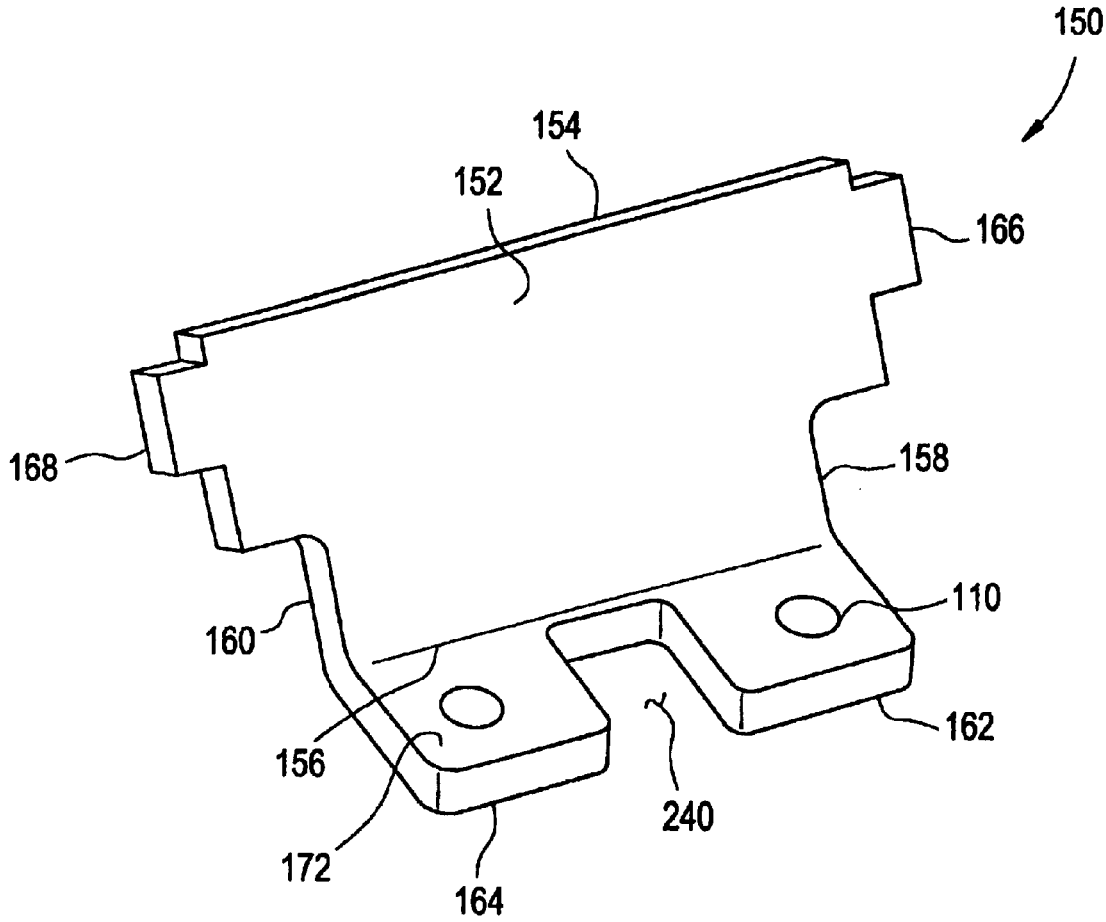
FIG. 8 is a perspective view of the plate of the mounting assembly of FIG. 6.

Referring to FIG. 8, a plate 150 is shown. Plate 150 includes a base 152 having a first edge 154, second edge 156, third edge 158 and fourth edge 160. Third edge 158 and fourth edge 160 are positioned between first and second edges 154, 156. Integral with the base 152 are two legs 162, 164 projecting outward from the base 152 along second edge 156. Preferably, the base 152 is angled relative to the legs 162, 164 and the legs 162, 164 project outward from the base 150 in a side-by-side relation. Preferably, the legs 162, 164 are generally adjacent to each other in the same plane and are separated by a cutout 240. Extending outward from third edge 158 is a projection 166. Extending outward from fourth edge 160 is a projection 168. Leg 162 also includes an aperture 170 preferably centrally located. Likewise, leg 164 includes an aperture 172 preferably centrally located.

Referring back to FIGS. 4, 5, 6 and 7, the mounting and securement of the motor operator mechanism 60 to the circuit breaker 10 (FIG. 1) will now be described.

The plate 150 is securely held between side frames 140, 142 of the operating mechanism 38 by inserting the projection 166 of plate 150 within opening 144 of side frame 140 and inserting the projection 168 of plate 150 within opening 146 of the side frame 142. When the mid cover 24 is then mounted on the base 26 of the circuit breaker 10, the apertures 130, 132 of the base portion 114 align with the apertures 170, 172 in the respective legs 162, 164 of the plate 150.

The bracket portion 112 is then set in position by inserting the bushings 134, 136 through respective apertures 108, 110 in the portion 106 of the mid cover 24 in order that the bushings 134, 136 align with the apertures 170, 172 located within the plate 150.

The mounting base 62 is then positioned on top of the mid cover 24 such that the toggle handle 44 extends through opening 94 and the free ends 128 of legs 124, 126 of the bracket portion 112 protrude outward from the cutout portion 104. In this way, the cutout portion 104, the apertures 130, 132 in the base 114 of the bracket portion 112, the respective apertures 108, 110 in the portion 106 of the mid cover 24 and the respective apertures 170, 172 in the plate 150 are all aligned such that respective mechanical fasteners 186, 188 can be inserted there through for full thread engagement.

Thus, the mechanical fasteners 186, 188 position and secure the bracket portion 112 within the mounting base 62 such that the bracket portion 112 is captively held within cut-out portion 104 of the mounting base 62. Further, mechanical fasteners 186, 188 also securely hold the bracket portion 112 to the plate 150 which is connected to the operating mechanism 38. In this way, the bracket portion 112 is also rigidly and securely connected to the operating mechanism 38. The mounting base 62 is then secured to the mid cover 24 by mechanical fasteners (not shown), preferably screws.

Once the mounting base 62 and bracket portion 112 are secured as described hereinabove, the motor operator mechanism 60 is connected to the mounting base 62. A rod 88 is inserted through a channel 90 (FIG. 6) formed within the mounting base 62. The side frames 68, 70 of the motor operator mechanism 60 are attached to end 74 of the mounting base 62 by insertion of rod 88 through respective holes 216, 220 within mounting base 62 and through apertures 86 located within respective side frames 70, 68. As rod 88 traverses side frame 68 and side frame 70 rocking motion of the motor operator mechanism 60 about rod 88 is permitted. When the motor operator mechanism 60 is in a retracted position, access to openings 96, 98 is provided.

Next, the side frames 68, 70 of the motor operator mechanism 60 are interlocked with the (respective) free ends 128 of the legs 124, 126 of the bracket portion 112. The recess 78 of side frame 68 captures the free end 128 of the leg 126. Likewise, the recess 206 of side frame 70 captures the free end 128 of the leg 124. When assembly is complete, as described hereinabove, the motor operator mechanism 60 is securely and accurately connected to the circuit breaker 10 and more particularly, the side frames 68, 70 of the motor operator mechanism 60 are securely connected to the respective side frames 140, 142 of the operating mechanism 38 ensuring against excessive lost motion between the motor operator mechanism 60 and the toggle handle 44 in a generally longitudinal direction as indicated by arrows on FIG. 3. Finally, mounting base 62 is attached to the mid cover 24 with mechanical fasteners (not shown) inserted through apertures 190, 192 within the mid cover 24.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for connecting a motor operator mechanism to side frames of a circuit breaker operating mechanism, the assembly comprising:

a plate connected between the side frames of the circuit breaker operating mechanism; and a bracket portion secured to said plate, said bracket portion engages the motor operating mechanism;

wherein said bracket portion couples and aligns the motor operator mechanism and the circuit breaker operating mechanism.

2. The assembly of claim 1 wherein said plate includes:

a base portion having a first edge and a second edge;

a first leg depending from said second edge of said base portion, said first leg having a screw accepting aperture;

a second leg depending from said second edge of said base portion and adjacent to said first leg, said second leg having a screw accepting aperture.

3. The assembly of claim 1 wherein said bracket portion including:

a base having a first end and a second end;

a first leg extending from said first end of said base; and a second leg extending from said second end of said base;

said first leg and said second leg each having a free end.

4. The assembly of claim 3 wherein said bracket portion is generally planar.

5. The assembly of claim 3 wherein said base of said bracket portion includes:

a first aperture and a first bushing, said first bushing aligns with said first aperture of said bracket portion; and a second aperture and a second bushing, said second bushing aligns with said second aperture of said bracket portion.

6. The assembly of claim 2 wherein said plate further includes:

a third edge and a fourth edge, said third and fourth edges interposed with said first edge and said second edge;

a first tab extending outward from said third edge; and a second tab extending outward from said fourth edge.

7. The assembly of claim 2 wherein said first leg of said plate and said second leg of said plate are angled outward from said base portion of said plate and lie substantially in the same plane to each other.

8. The assembly of claim 5 wherein said first aperture of said base of said bracket portion aligns with said screw accepting aperture of said first leg of said plate and said second aperture of said base of said bracket portion aligns with said screw accepting aperture of said second leg of said plate.

9. The assembly of claim 8 further comprising a screw threadingly engaged through said first aperture of said base and said screw accepting aperture of said first leg of said plate.

10. The assembly of claim 3 wherein said free end of said first leg of said bracket portion connects with the motor operator mechanism and said free end of said second leg of said bracket portion connects with the motor operator mechanism.

11. A circuit breaker assembly comprising:

an insulated case;

a circuit breaker operating mechanism including a first side frame and a second side frame, said first side frame and said second side frame mounted within said insulated case;

a motor operator mechanism; and an assembly including:

a plate connected between said first side frame and said second side frame of said circuit breaker operating mechanism; and a bracket portion secured to said plate, said bracket portion engages said motor operating mechanism;

wherein said bracket portion couples and aligns said motor operator mechanism and said circuit breaker operating mechanism.

12. The circuit breaker assembly of claim 11 wherein said plate includes:

a base having a first edge and a second edge;

a first leg depending from said first edge of said base portion, said first leg having a screw accepting aperture;

a second leg depending from said first edge of said base portion and adjacent to said first leg, said second leg having a screw accepting aperture.

13. The circuit breaker assembly of claim 11 wherein said bracket portion including:

a base having a first end and a second end;

a first leg extending from said first end of said base; and a second leg extending from said second end of said base;

said first leg and said second leg each having a free end.

14. The circuit breaker assembly of claim 13 wherein said bracket portion is generally planar.

15. The circuit breaker assembly of claim 13 wherein said base of said bracket portion includes:

a first aperture and a first bushing, said first bushing aligns with said first aperture of said bracket portion; and a second aperture and a second bushing, said second bushing aligns with said second aperture of said bracket portion.

16. The circuit breaker assembly of claim 12 wherein said plate further includes:

a third edge and a fourth edge, said third and fourth edges interposed with said first edge and said second edge;

a first tab extending outward from said third edge; and a second tab extending outward from said fourth edge.

17. The circuit breaker assembly of claim 12 wherein said first leg of said plate and said second leg of said plate are each angled outward from said base portion of said plate and lie substantially in the same plane to each other.

18. The circuit breaker assembly of claim 15 wherein said first aperture of said base of said bracket portion align with said screw accepting aperture of said first leg of said plate and said second aperture of said base of said bracket portion align with said screw accepting aperture of said second leg of said plate.

19. The circuit breaker assembly of claim 13 wherein said free end of said first leg of said bracket portion connects with the motor operator mechanism and said free end of said second leg of said bracket portion connects with the motor operator mechanism.

20. The circuit breaker assembly of claim 16 wherein said first side frame of said circuit breaker operating mechanism having a first opening and said second side frame of said circuit breaker operating mechanism having a second opening;

said first tab of said plate received within said first opening of said first side frame and said second tab of said plate received within said second opening of said second side frame.

21. The circuit breaker assembly of claim 15 further including:

a mounting base mounted on said insulated case, said mounting base having an opening and a cut out portion proximate to said opening; and a handle extending outward from said insulated case and said opening of said mounting base;

wherein said free end of said first leg of said bracket portion and said free end of said second leg of said bracket portion extend through said cut out portion of said mounting base.

22. The circuit breaker assembly of claim 21 wherein said motor operator mechanism includes:

a first side frame connected to a second side frame, said first side frame and said second side frame mounted within said motor operator mechanism and interconnected each having an edge, said edge having a first end and a second end and said mounting base includes a first end and a second end;

said first end of said first side frame of said motor operator mechanism and said first end of said second side frame of said motor operator mechanism are pivotally mounted to said second end of said mounting base;

said first end of said first side frame of said motor operator mechanism and said first end of said second side frame of said motor operator mechanism each having a recess;

said free end of said first leg of said bracket portion engaged with said recess of said first side frame of said motor operator mechanism and said free end of said second leg of said bracket portion engaged with said recess of said second side frame of said motor operator mechanism.

23. The circuit breaker assembly of claim 21 further comprising a screw threadingly engaged through said cut out portion of said mounting base, said first aperture of said base and said screw accepting aperture of said first leg of said plate.

* * * * *